US008057330B2

(12) United States Patent
Blosser et al.

(10) Patent No.: US 8,057,330 B2
(45) Date of Patent: Nov. 15, 2011

(54) ADAPTORS FOR MOUNTING ARROWHEADS TO ARROW SHAFTS

(75) Inventors: Ben Blosser, Richland, IN (US); Sean Gordon, Evansville, IN (US); Mark Wenberg, Newburgh, IN (US)

(73) Assignee: Bear Archery, Inc., Evansville, IN (US)

( * ) Notice: Subject to any disclaimer, the term of this patent is extended or adjusted under 35 U.S.C. 154(b) by 484 days.

(21) Appl. No.: 12/209,676

(22) Filed: Sep. 12, 2008

(65) Prior Publication Data

US 2009/0075766 A1 Mar. 19, 2009

Related U.S. Application Data

(60) Provisional application No. 60/972,393, filed on Sep. 14, 2007.

(51) Int. Cl.
*F42B 6/08* (2006.01)

(52) U.S. Cl. ..... 473/582

(58) Field of Classification Search ..... 473/578, 473/582, 583, 586; 285/398
See application file for complete search history.

(56) References Cited

U.S. PATENT DOCUMENTS

| | | | | |
|---|---|---|---|---|
| 1,762,766 | A * | 6/1930 | De Garay | 285/331 |
| 1,846,460 | A * | 2/1932 | Smelser | 131/225 |
| 2,470,359 | A * | 5/1949 | McLean | 285/109 |
| 2,940,758 | A | 6/1960 | Richter | |
| 3,138,383 | A | 6/1964 | McKinzie | |
| 3,401,938 | A | 9/1968 | Bear | |
| 3,433,505 | A * | 3/1969 | Weatherhead | 285/148.18 |
| 3,868,114 | A | 2/1975 | Groner | |
| 4,141,554 | A | 2/1979 | Sherwin | |
| 4,341,391 | A | 7/1982 | Anderson | |
| 4,410,184 | A | 10/1983 | Anderson | |
| 4,579,348 | A | 4/1986 | Jones | |
| 4,943,067 | A | 7/1990 | Saunders | |
| 4,944,520 | A * | 7/1990 | Fingerson et al. | 473/582 |
| 5,145,186 | A | 9/1992 | Maleski | |
| 5,494,298 | A | 2/1996 | Maleski | |
| 5,496,043 | A | 3/1996 | Ester | |
| 5,516,117 | A | 5/1996 | Rangel | |
| 5,611,542 | A | 3/1997 | Saunders | |
| 5,636,846 | A | 6/1997 | Tinsley | |
| 5,803,844 | A | 9/1998 | Anderson | |
| 5,803,845 | A | 9/1998 | Anderson | |
| 5,820,498 | A | 10/1998 | Maleski | |
| 5,921,875 | A | 7/1999 | Bickel | |
| 6,045,468 | A | 4/2000 | Tinsley et al. | |
| 6,142,895 | A | 11/2000 | Jason | |
| 6,290,903 | B1 | 9/2001 | Grace, Jr. et al. | |
| 6,739,992 | B2 | 5/2004 | Kummerle | |
| 6,875,138 | B2 | 4/2005 | Perkins, Sr. | |
| 6,921,348 | B1 | 7/2005 | Johnson | |
| 6,932,728 | B2 | 8/2005 | Palomaki et al. | |
| 7,004,859 | B2 | 2/2006 | Palomaki et al. | |

(Continued)

*Primary Examiner* — John Ricci
(74) *Attorney, Agent, or Firm* — Woodard, Emhardt, Moriarty, McNett & Henry LLP

(57) ABSTRACT

Adaptors for mounting arrowheads to arrow shafts are disclosed. Example embodiments include an outer attachment portion that engages the outer surface of a hollow arrow shaft, and an inner attachment portion that engages the inner surface of the hollow arrow shaft. Other embodiments may include single-piece adaptors configured to receive the end of a hollow arrow shaft, and adaptors with arrowhead receiving portions. Still other embodiments may include an inner attachment portion that is inserted into the hollow of a hollow arrow shaft and an outer attachment portion that surrounds and receives the outer surface of the hollow arrow shaft.

21 Claims, 6 Drawing Sheets

U.S. PATENT DOCUMENTS 7,077,770 B2 7/2006 Palomaki et al.
7,115,055 B2 10/2006 Palomaki et al.
7,811,186 B2 * 10/2010 Palomaki et al. ..... 473/578
2009/0163308 A1 * 6/2009 Odabachian et al. ..... 473/582

* cited by examiner

ADAPTORS FOR MOUNTING ARROWHEADS TO ARROW SHAFTS

This application claims the benefit of U.S. Provisional Application No. 60/972,393, filed Sep. 14, 2007 , the entirety of which is hereby incorporated herein by reference.

FIELD OF THE INVENTION

The present invention relates generally to archery arrows and more particularly pertains to an adaptor used to mount arrowheads to arrow shafts.

BACKGROUND

Archery arrows are used with a bow for shooting, typically for target practice or game hunting. Many such arrows include a hollow shaft and in recent years have been made of lighter materials such as composite carbon fiber shafts. When used with an arrowhead, the shaft end is subjected to impact forces when the arrow hits the desired target. These forces can potentially damage lightweight materials of the shaft, necessitating repair or replacement of the arrow shaft.

Furthermore, in use, it is important to align and balance the arrowhead axis and weight with the central axis of the arrow shaft to maintain the desired flight of the arrow without wobble or drift from the expected trajectory.

An adaptor to mount an arrowhead to a shaft which provides strength at the junction of the arrowhead to the shaft and which maintains longitudinal alignment of the arrowhead with the shaft axis is desired.

Objects and attendant advantages of this invention will be readily appreciated as the same become more clearly understood by references to the following detailed description when considered in connection with the accompanying drawings in which like reference numerals designate like parts throughout the figures thereof.

SUMMARY

It is an object of the present invention to provide an improved adaptor for mounting arrowheads to arrow shafts. In accordance with a first aspect of embodiments of the present invention, a single-piece arrowhead adaptor is provided with an inner attachment portion and an outer attachment portion. The single-piece arrowhead adaptor is further configured to engage a hollow arrow shaft between the inner and outer attachment portions with the inner attachment portion being inserted within the hollow of the arrow shaft.

In accordance with another aspect of embodiments of the present invention, an arrow shaft adaptor is provided with an arrowhead attachment portion, an inner shaft attachment portion and an outer shaft attachment portion. The arrowhead attachment portion is configured to attach to an arrowhead, and the inner shaft attachment portion and the outer shaft attachment portion are configured to engage therebetween the end of a hollow arrow shaft.

In accordance with still another aspect of embodiments of the present invention, a cylindrical arrow shaft adaptor with a front portion and a rear portion is provided. The front portion is adapted for connection to an arrowhead and the rear portion is adapted for connection to a hollow arrow shaft. The rear portion includes an annular ring receptacle with an inward facing surface and an outward facing surface, the annular ring receptacle being adapted to receive in nesting engagement an end of the hollow arrow shaft.

In accordance with yet another aspect of embodiments of the present invention, a hollow arrow shaft is provided with an outer surface and an inner surface, the inner surface defining a cavity of the hollow arrow shaft. At least one fletching is attached to the hollow arrow shaft. A nock is attached to the hollow arrow shaft and is adapted to receive a bowstring. An arrow shaft adaptor with an inner attachment portion and an outer attachment portion is also provided, the inner attachment portion being in flush engagement with the arrow shaft inner surface, and the outer attachment portion being in flush engagement with the arrow shaft outer surface. An arrow head is also provided and is engaged with the arrow shaft adaptor.

This summary is provided to introduce a selection of the concepts that are described in further detail in the detailed description and drawings contained herein. This summary is not intended to identify any primary or essential features of the claimed subject matter, nor is it intended to be used as an aid in determining the scope of the appended claims. Each embodiment described herein is not intended to address every object described herein, and each embodiment does not include each feature described. Other forms, embodiments, objects, advantages, benefits, features, and aspects of the present invention will become apparent to one of skill in the art from the detailed description and drawings contained herein.

DETAILED DESCRIPTION OF THE ILLUSTRATED EMBODIMENTS

Figure 1:
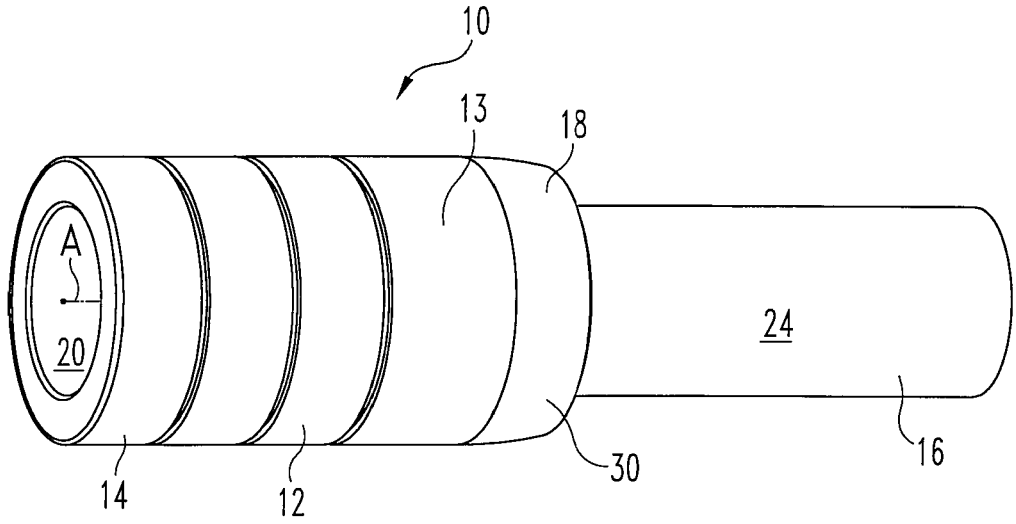
FIG. 1 illustrates a frontal perspective view of an arrow shaft to arrowhead adaptor according to one embodiment of the present invention.

For the purposes of promoting an understanding of the principles of the invention, reference will now be made to the selected embodiments illustrated in the drawings and specific language will be used to describe the same. It will nevertheless be understood that no limitation of the scope of the invention is hereby intended, such alterations, modifications, and further applications of the principles of the invention being contemplated as would normally occur to one skilled in the art to which the invention relates. At least one embodiment of the invention is shown in great detail, although it will be apparent to those skilled in the relevant art that some features that are not relevant to the present invention may not be shown for the sake of clarity.

Embodiments of the present invention generally assist in mounting an arrowhead to an arrow shaft. Preferably, the adaptor enhances the strength of the junction between the arrowhead and the arrow shaft as well as maintaining alignment of the arrowhead with the central axis of the shaft. In one characterization, the adaptor includes an insert section received in the open end of an arrow shaft and an outsert section which surrounds the outer end of the arrow shaft. The forward end of the adaptor is configured to receive an arrowhead such as a target point or a broadhead style arrowhead.

Figure 2:
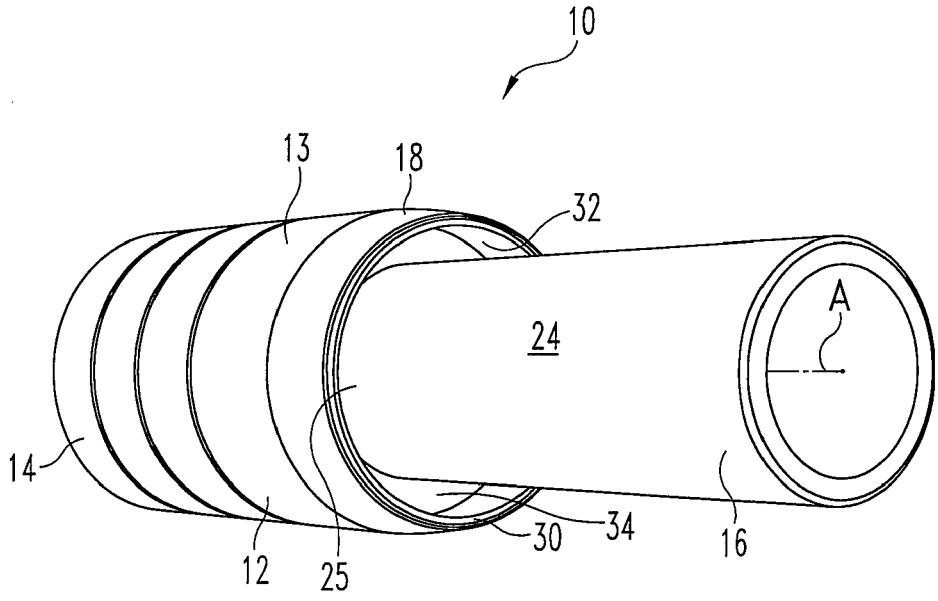
FIG. 2 is a rearward perspective view of the embodiment of FIG. 1.
Figure 3:
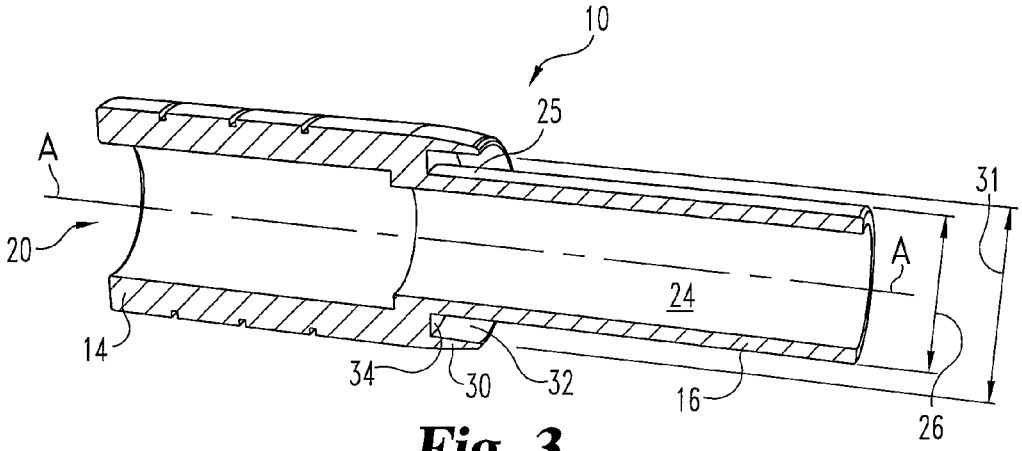
FIG. 3 is a cross-sectional view of the embodiment of FIG. 1.

Illustrations of an adaptor 10 according to a preferred embodiment of the present invention are shown in FIGS. 1-3. Adaptor 10 includes a body 12 with a forward end 14 and a rearward end 16. Forward end 14 has an arrowhead attachment portion, such as forward facing opening 20, into which an arrowhead can be mounted, for example by threaded engagement, a frictional mount or alternate style engagement mechanisms such as spring clips. Rearward portion 16 preferably includes an inner attachment portion, such as reduced diameter insert section 24, extending rearwardly from the central portion 13 of body 12 and including outward facing surface or wall 25.

The central portion 13 of body 12 has an outer attachment portion, such as rearward section 18, with an outer wall which forms an "outset" flange or rim 30 extending rearward and slightly overlapping insert section 24. In the illustrated embodiment, rim 30 overlaps insert section 24 for approximately one-seventh (1/7) the length of insert section 24. Flange 30 is spaced outward with a larger inner diameter 31 than the outer diameter 26 of insert section 24. Flange 30 defines an inward facing surface or wall 32 along the inner diameter. A shaft abutment surface, such as rearward facing surface 34, is perpendicular to the central axis A of adaptor 10 and extends between insert section 24 and inward facing surface 32. The arrangement of inset section 24, inward facing surface 32 and rearward facing surface 34 forms a rearward opening annular ring receptacle or volume into which the forward end of an arrow shaft can be nested.

Figure 4:
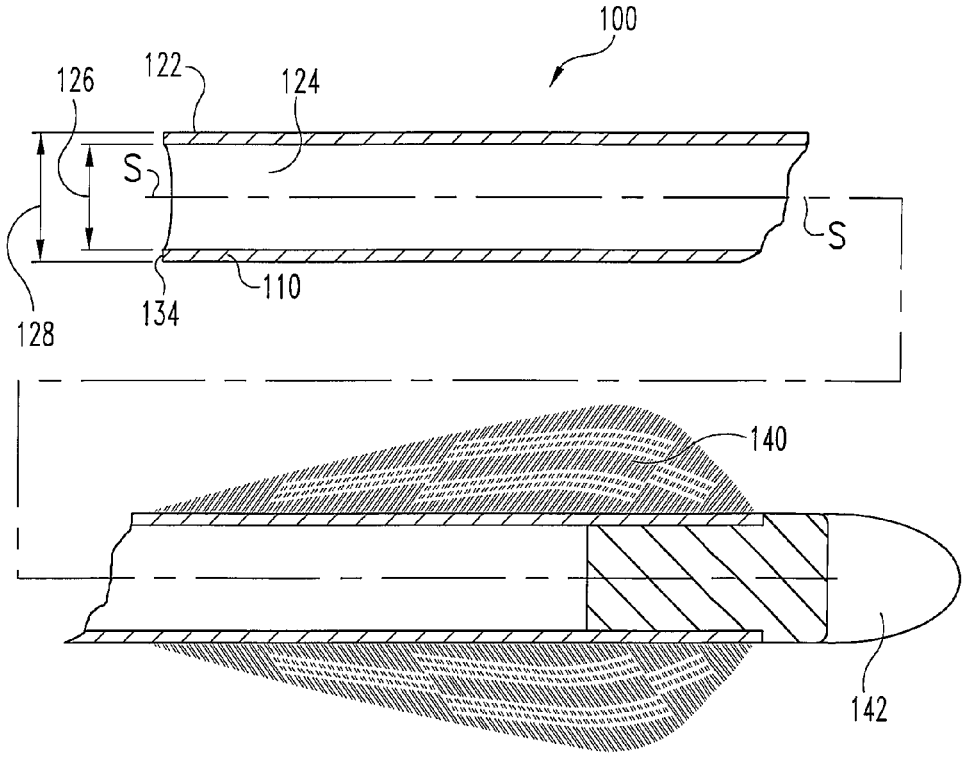
FIG. 4 is a cross-sectional view of an arrow shaft.

FIG. 4 illustrates a cylindrical arrow shaft 100 useable with adaptor 10. Forward end 110 of arrow shaft 100 preferably includes a wall with an outer surface 122, a forward end face 134 and an inner passage 124. Inner passage 124 preferably defines an inner diameter 126 with the wall thickness of the arrow shaft defining a shaft outer diameter 128. The thickness of the shaft walls when viewed from the front defines the forward end face 134 of shaft 100. Face 134 is generally perpendicular to the central axis S of the shaft. The rearward end of arrow shaft 100 typically includes at least one fletching 140 to help guide the arrow during flight and a nock 142 that forms a releasable coupling with the bowstring.

Figure 5:
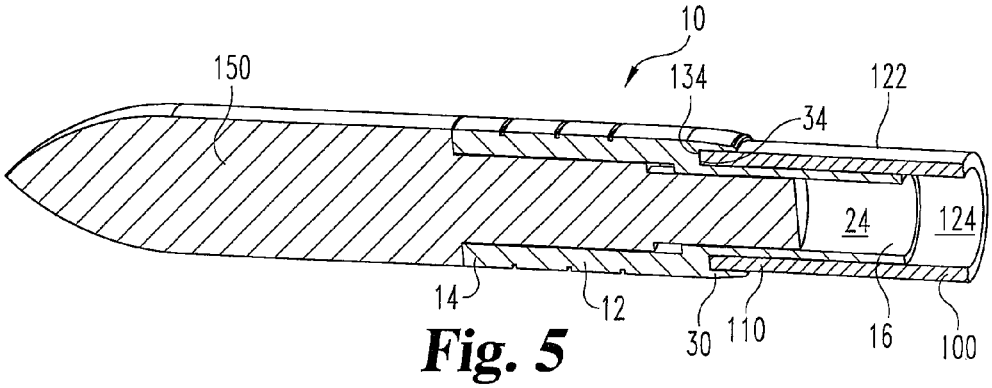
FIG. 5 is a cross-sectional view of the embodiment of FIG. 1 with the arrow shaft of FIG. 4 and an arrowhead.

In use, as illustrated in FIG. 5, adaptor 10 is arranged to engage an arrowhead 150 at the front end and shaft 100 to the rear. In the assembled form, the insert section 24 of adaptor 10 is received within passage 124 of forward arrow shaft end 110 with the outer diameter of insert section 24 sized to closely fit with the inner diameter of passage 124. In one example embodiment, the outer diameter 26 of insert section 24 approximately equals the inner diameter 126 of shaft 100. The annular ring or space of adaptor 10 receives the forward end 110 of arrow shaft 100 with forward end face 134 of the arrow shaft nested and abutting rearward facing surface 34 of adaptor 10. Flange section 30 includes an inward facing surface 32 defining an outer diameter of the ring which is sized to closely receive the outer diameter of arrow shaft end 110. In one example embodiment, the inner diameter 31 of flange 30 approximately equals the outer diameter 128 of shaft 100. When assembled, flange 30 extends partially rearwardly over arrow shaft 110 to capture the end of the arrow shaft. This arrangement enhances the strength of the connection between adaptor 10 and the arrow shaft 100

An arrowhead 150 is arranged and mounted to the forward end 14 of adaptor 10.

Adaptor 10 is securable to shaft 100. Example methods of securing adaptor 10 to shaft 100 include a friction fit, a threaded engagement, adhesive, spines, barbs and/or spring clips.

In use, the alignment of insert section 24 with inner passage 124 of the shaft enhances the adaptor 10's ability to maintain alignment of the adaptor and subsequent arrowheads relative to the arrow shaft axis S. Additionally, the nesting or capturing of the forward end 110 of arrow shaft 100, including forward end face 134 and outer surface 122, within flange 30 enhances the adaptor 10's ability to provide a secure outer fit, increase the strength of the connection, and minimize damage to the forward end of the arrow shaft, such as by splitting, chipping or otherwise deforming upon impact of the arrowhead with the target.

Certain embodiments of the present invention include an adaptor with a single-piece body of unitary construction. The unitary construction can enhance the strength and durability of the adaptor, which can be important when the adaptor is attached to an arrow that is shot repeatedly into a target. The unitary construction can also avoid some difficulties associated with prior adaptors, for example, adaptors that are inserted into the hollow end of an arrow shaft and used in combination with an arrow head, which may include a portion that extends partially over the outer surface of the arrow shaft. These arrangements are more complex, include additional parts, and require additional steps and time for assembly than the single-piece adaptors of the present invention.

Arrow shaft 100 in certain embodiments is a carbon fiber reinforced shaft although alternate materials for hollow shafts such as aluminum or wood can be used. Adaptor 10 is preferably made of a lightweight material with sufficient strength to withstand the impact forces involved. Examples of materials for the adaptor include aluminum, steel, such as stainless steel, or other lightweight yet strong metals such as titanium. Certain plastics, resins or composites that provide sufficient strength and durability may also be used for the adaptor. Adaptor 10 can be made in various manners such as casting or machining.

The arrowhead attachment portion is depicted as a forward facing opening; however, other embodiments include different types of arrowhead attachment portions for securing an arrowhead to adaptor 10. Additional example embodiments include protruding arrowhead attachment portions where the arrowhead is mounted over the protrusion.

Furthermore, alternate embodiments include differently shaped annular ring receptacles to, for example, enhance securement to the arrow shaft, maintain alignment, minimize structural damage to or degradation of the arrow shaft, and/or accept different arrow shaft shapes and sizes. Minimizing structural damage to or structural degradation of the arrow shaft can be particularly desirable when the arrow is reused repeatedly, such as during target practice. Additionally, the material from which the arrow shaft is made can affect which type of annular cavity is suited to provide preferred results.

Figure 6A:
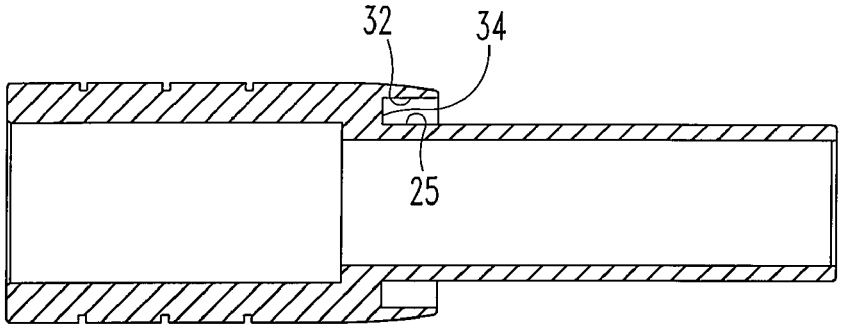
FIG. 6A is a cross-sectional view of the embodiment of FIG. 1.
Figure 6B:
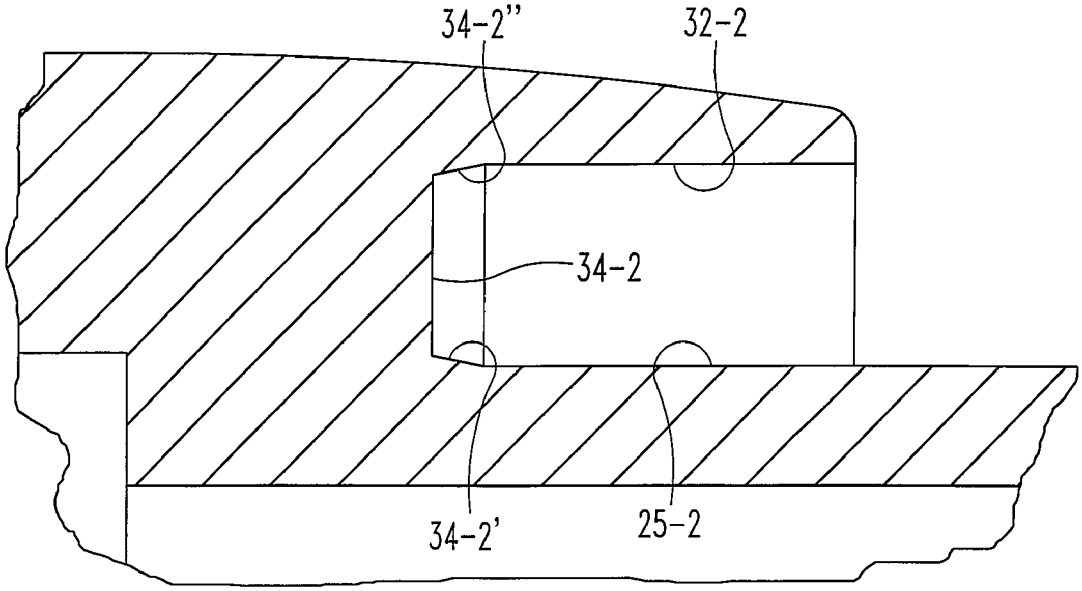
FIG. 6B is a fragmentary cross-sectional view of an arrow shaft to arrowhead adaptor according to another embodiment of the present invention.

The embodiment depicted in FIG. 6A includes an annular ring receptacle with sides (outward facing surface 25, inward facing surface 32 and rearward facing surface 34) that are flat in cross-section and intersect at right angles. An alternate embodiment includes the annular ring receptacle shape depicted in FIG. 6B. In FIG. 6B, beveled surface 34-2' adjoins rearward facing surface 34-2 and outward facing surface 25-2, and beveled surface 34-2" adjoins rearward facing surface 34-2 and inward facing surface 32-2.

Figure 6C:
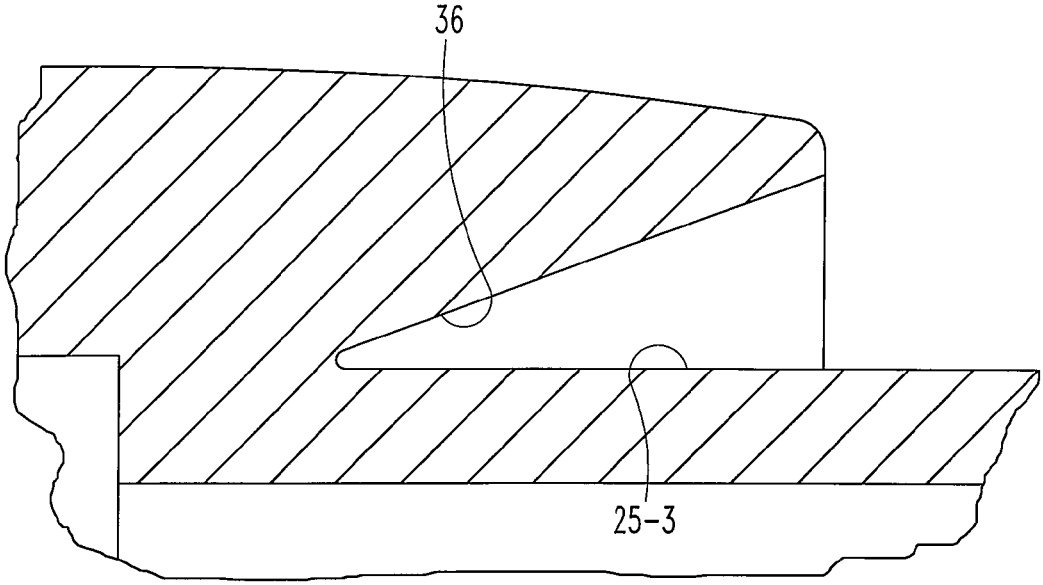
FIG. 6C is a fragmentary cross-sectional view of an arrow shaft to arrowhead adaptor according to a further embodiment of the present invention.

The example embodiment depicted in FIG. 6C includes an obliquely angled or tapered surface 36 that is both rearward and downward facing, and is blended (rounded) into outward facing surface 25-3.

Figure 6D:
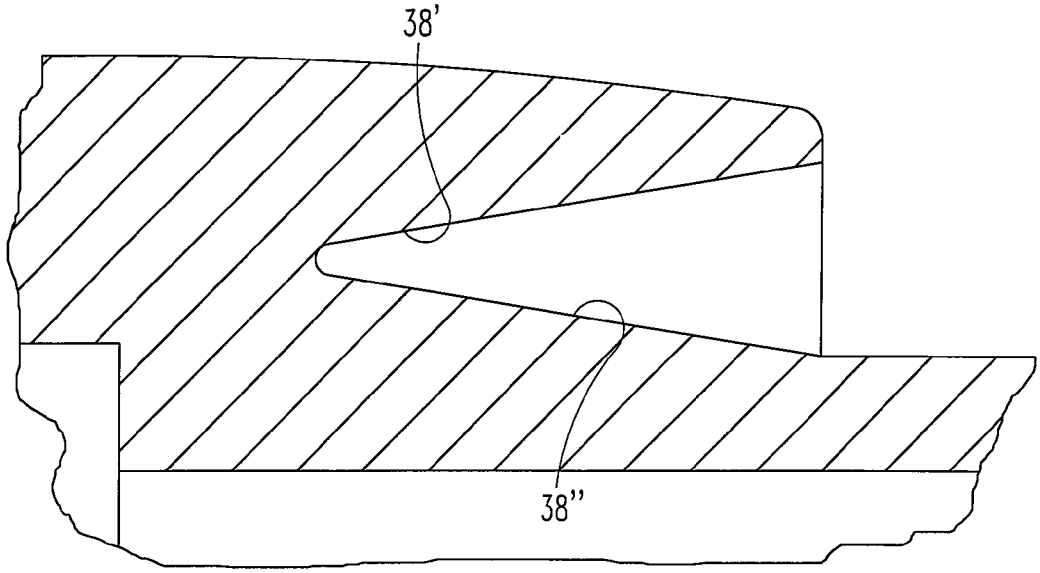
FIG. 6D is a fragmentary cross-sectional view of an arrow shaft to arrowhead adaptor according to still another embodiment of the present invention.

As another example, the embodiment depicted in FIG. 6D includes angled surfaces 38' and 38". The surfaces are smoothed (blended) together to minimize creation of stress risers that may arise when joining surfaces with sharp angles and may lead to cracking.

Figure 6E:
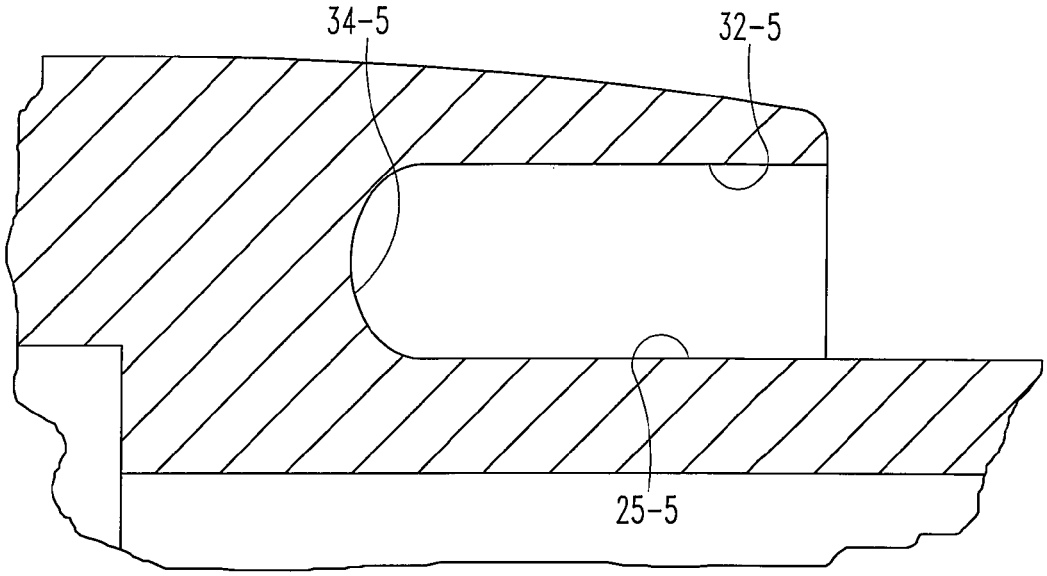
FIG. 6E is a fragmentary cross-sectional view of an arrow shaft to arrowhead adaptor according to yet another embodiment of the present invention.

As still another example, the embodiment depicted in FIG. 6E includes an annular ring receptacle shape with a rounded surface 34-5 adjoining inward facing surface 32-5 and outward facing surface 25-5.

Figure 6F:
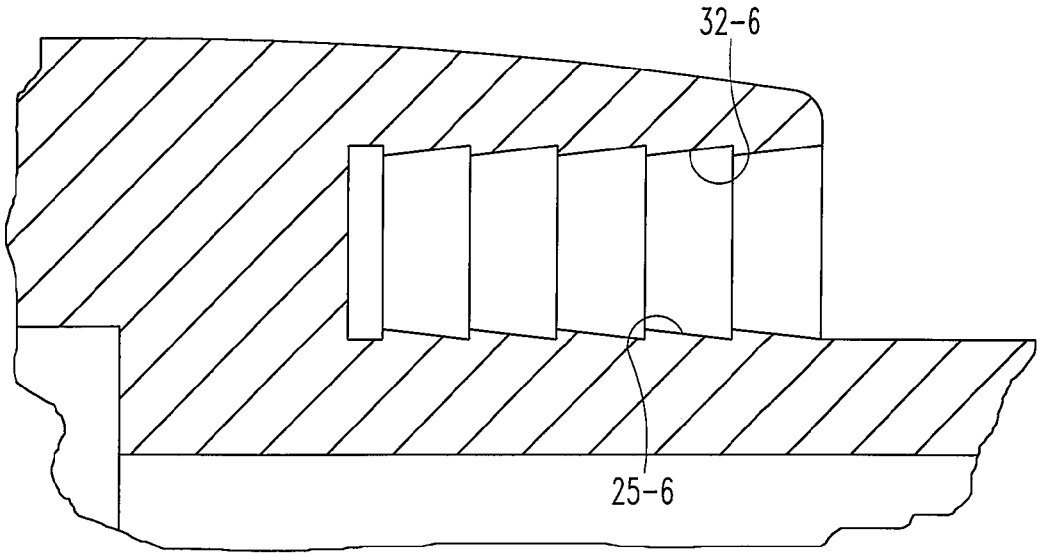
FIG. 6F is a fragmentary cross-sectional view of an arrow shaft to arrowhead adaptor according to still a further embodiment of the present invention.

The embodiment depicted in FIG. 6F includes an annular ring receptacle bounded by a serrated inward facing surface 32-6 and a serrated outward facing surface 25-6.

Figure 6G:
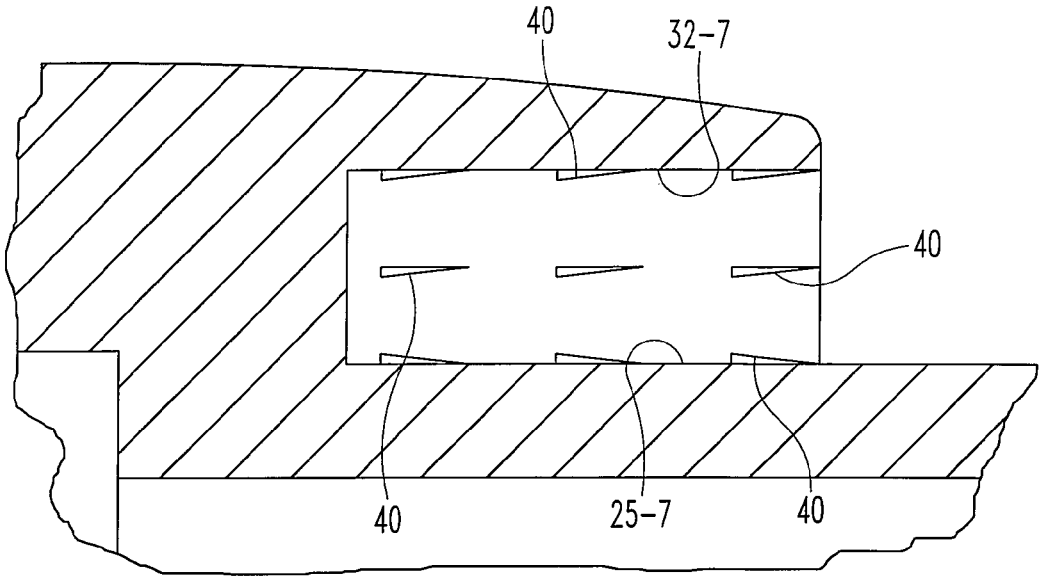
FIG. 6G is a fragmentary cross-sectional view of an arrow shaft to arrowhead adaptor according to another embodiment of the present invention.

The embodiment depicted in FIG. 6G includes barbs 40 on inward facing surface 32-7 and/or outward facing surface 25-7. The number and placement of barbs 40 can be adjusted to provide enhanced securement to, alignment with and/or support for the arrow shaft.

Figure 6H:
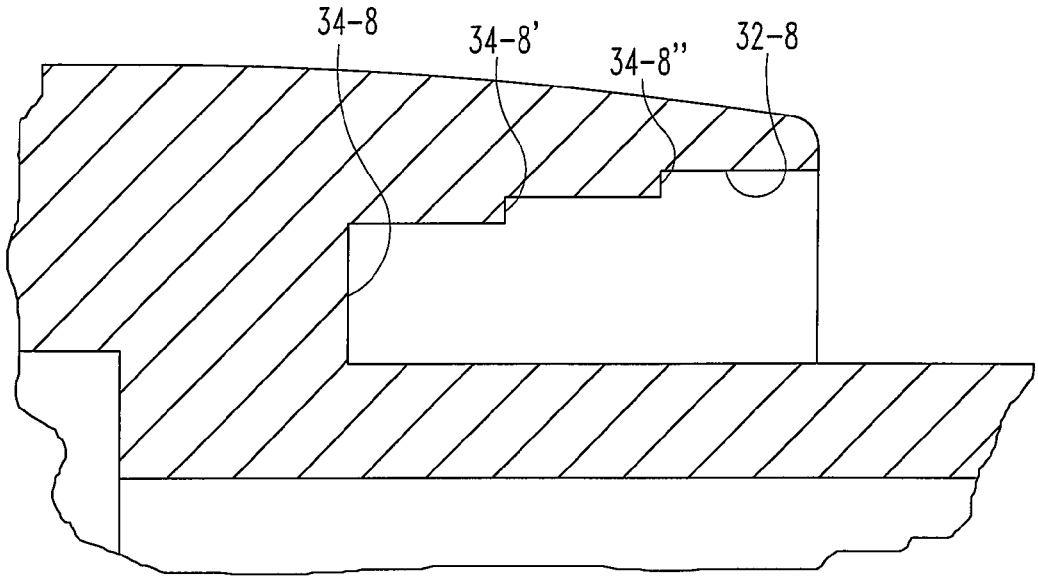
FIG. 6H is a fragmentary cross-sectional view of an arrow shaft to arrowhead adaptor according to yet a further embodiment of the present invention.

As yet another example, the embodiment depicted in FIG. 6H includes a stepped inward facing surface 32-8 that presents, for example, three rearward facing surfaces 34-8, 34-8' and 34-8". The embodiment depicted in FIG. 6H can accept different arrow shaft sizes while still providing enhanced securement to and stability for the arrow shaft.

The annular ring receptacles depicted in FIGS. 6A-6H are adapted to receive standard arrow shafts, such as the arrow shaft 100 depicted in FIG. 4. The annular ring receptacles depicted in FIGS. 6A-6H are also adapted to receive arrow shafts with contoured outer surfaces, including contoured outer surfaces that are sized to mate with the adaptor's outward facing, inward facing and/or rearward facing surfaces. For example, an arrow shaft end may be contoured with serrated outer and inner surfaces similar and complimentary to the inward facing and outward facing surfaces 32-6 and 25-6 depicted in FIG. 6F such that the surfaces are in flush engagement when the adaptor and the arrow shaft are connected.

Furthermore, while inward facing surface 32 and outward facing surface 25 (see FIG. 2 for example) have generally been depicted as circular cylindrical surfaces (circular when viewed in a cross section that is perpendicular to the arrow shaft central axis S (FIG. 4)), other embodiments include annular ring receptacles with differently shaped cylindrical cross sectional shapes. Example additional cross sectional shapes include square, hexagonal and octagonal, and provide alignment with, support for, and/or securement to the arrow shaft. Some embodiments include an inward facing surface 32 with a different cross sectional shape than outward facing surface 25, provided that there is sufficient alignment, support and/or securement when the arrow shaft is mounted thereto.

While illustrated examples, representative embodiments and specific forms of the invention have been illustrated and described in detail in the drawings and foregoing description, the same is to be considered as illustrative and not restrictive or limiting. Any of the foregoing aspects of the present invention may be used in combination with other features, whether or not explicitly described as such. Dimensions, whether used explicitly or implicitly, are not intended to be limiting and may be altered as would be understood by one of ordinary skill in the art. Only exemplary embodiments have been shown and described, and all changes and modifications that come within the spirit of the invention are desired to be protected.

What is claimed is:

1. An archery apparatus, comprising:

an arrow shaft with at least one fletching and a nock;

a single-piece arrowhead adaptor with an inner attachment portion and an outer attachment portion, the single-piece arrowhead adaptor attached to the hollow arrow shaft between the inner and outer attachment portions with the inner attachment portion being inserted within the hollow of the arrow shaft; and, an arrowhead attached to the single-piece arrowhead adaptor wherein said arrowhead has a rearward portion extending into a hollow cavity within said arrow shaft.

2. The archery apparatus of claim 1, further comprising an arrowhead attachment portion adapted to attach to an arrowhead, said arrowhead attachment portion including a cavity to receive a portion of an arrowhead wherein said cavity is defined by a forward facing opening to an interior passage extending into said inner attachment portion.

3. The archery apparatus of claim 1, further comprising an arrow shaft abutment surface adjacent said inner and outer attachment portions and adapted to contact the end face of the hollow arrow shaft, the arrow shaft abutment surface being substantially planar and perpendicular to the arrow shaft axis when the arrowhead adaptor is attached to the arrow shaft.

4. The archery apparatus of claim 1, wherein the inner attachment portion defines a hollow cylinder.

5. The archery apparatus of claim 1, wherein the inner attachment portion defines an outward facing surface sized and contoured for flush engagement with the hollow arrow shaft inner surface; and wherein the outer attachment portion defines an inward facing surface sized and contoured for flush engagement with the hollow arrow shaft outer surface.

6. The archery apparatus of claim 1, wherein an outward facing surface of said inner attachment portion and an inward facing surface of said outer attachment portion are non-parallel.

7. The archery apparatus of claim 1, wherein the outward facing surface of said inner attachment portion or the inward facing surface of said outer attachment portion is serrated or barbed.

8. The archery apparatus of claim 1, wherein the single-piece arrowhead adaptor is configured to frictionally grip the arrow shaft between the inner and outer attachment portions.

9. The archery apparatus of claim 1, wherein said single-piece adaptor is made of a lightweight metal selected from the group consisting of aluminum, steel, stainless steel and titanium.

10. The archery apparatus of claim 1, wherein an outward facing surface of said inner attachment portion and an inward facing surface of said outer attachment portion form a stepped arrangement to fit different arrow shaft sizes.

11. An archery adaptor attaching an arrowhead to an arrow shaft, comprising:

an arrowhead;

a single-piece arrow shaft adaptor of unitary construction with an arrowhead attachment portion, an inner shaft attachment portion and an outer shaft attachment portion, the arrowhead attachment portion attached to the arrowhead, and the inner shaft attachment portion and the outer shaft attachment portion configured to engage therebetween the end of a hollow arrow shaft;

wherein said arrowhead has a rearward portion configured to extend into a hollow cavity within the arrow shaft.

12. The adaptor of claim 11, wherein the inner shaft attachment portion defines a hollow cylinder.

13. The adaptor of claim 11, wherein the inner shaft attachment portion includes an outer surface defining a diameter equal to the inner diameter of the hollow arrow shaft and adapted to be inserted into the hollow arrow shaft and includes an inner portion to receive a portion of an arrowhead extending into said arrow shaft.

14. The adaptor of claim 11, wherein the inner shaft attachment portion extends into the shaft a distance that is longer than the distance the outer attachment portion extends along the arrow shaft outer surface.

15. The adaptor of claim 14, wherein the outer attachment portion overlaps the inner shaft attachment portion for approximately one-seventh of the length of the inner shaft attachment portion.

16. An adaptor attaching an arrowhead to an arrow shaft, comprising:

an arrowhead with a rearward portion;

a cylindrical arrow shaft adaptor with a front portion and a rear portion;

the rear portion adapted for connection to a hollow arrow shaft, the rear portion including an annular ring receptacle with an inward facing surface and an outward facing surface, the annular ring receptacle being adapted to receive in nesting engagement an end of the hollow arrow shaft, said front portion and said rear portion defining a cavity adapted for connection to the arrowhead, wherein said cavity is defined by a forward facing opening to an interior passage extending through said front portion into said rear portion, wherein said rearward portion of said arrowhead extends into said arrow shaft within said cavity when said adapter is connected to the hollow arrow shaft.

17. The adaptor of claim 16, wherein the inward and outward facing surfaces are adapted to frictionally mate with the hollow arrow shaft end.

18. The adaptor of claim 16, wherein the cylindrical arrow shaft adaptor is a single piece of unitary construction.

19. An arrow for archery, comprising:

a hollow arrow shaft with an outer surface and an inner surface, the inner surface defining a cavity of the hollow arrow shaft;

at least one fletching attached to the hollow arrow shaft;

a nock attached to the hollow arrow shaft and adapted to receive a bowstring;

an arrow shaft adaptor with an inner attachment portion and an outer attachment portion, the inner attachment portion being in flush engagement with the arrow shaft inner surface, and the outer attachment portion being in flush engagement with the arrow shaft outer surface; and an arrowhead engaged with the arrow shaft adaptor and extending into said inner attachment portion of said arrow shaft adaptor.

20. The arrow of claim 19, wherein the arrow shaft adaptor is a single piece of unitary construction.

21. The arrow of claim 20, wherein the inner attachment portion extends into the shaft a distance that is longer than the distance the outer attachment portion extends along the arrow.

* * * * *